US008955576B2

(12) United States Patent
Albert et al.

(10) Patent No.: US 8,955,576 B2
(45) Date of Patent: Feb. 17, 2015

(54) CAST FEATURES FOR A TURBINE ENGINE AIRFOIL

(71) Applicant: United Technologies Corporation, Hartford, CT (US)

(72) Inventors: Jason Edward Albert, Greenville, SC (US); Atul Kohli, Tolland, CT (US); Eric L. Couch, Frederick, MD (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 14/155,545

(22) Filed: Jan. 15, 2014

(65) Prior Publication Data

US 2014/0190654 A1 Jul. 10, 2014

Related U.S. Application Data

(60) Continuation of application No. 13/159,469, filed on Jun. 14, 2011, now Pat. No. 8,695,683, which is a division of application No. 11/685,840, filed on Mar. 14, 2007, now Pat. No. 7,980,819.

(51) Int. Cl.
*B22C 9/10* (2006.01)
*B22C 9/24* (2006.01)
(Continued)

(52) U.S. Cl.
CPC ..... *B22C 9/24* (2013.01); *F05D 2260/202* (2013.01); *B22C 9/04* (2013.01); *F05D 2230/21* (2013.01); *F01D 25/12* (2013.01); *F01D 5/186* (2013.01); *B22C 9/108* (2013.01)
USPC ..... 164/370; 164/369; 416/97 R; 249/135; 249/175

(58) Field of Classification Search
CPC ..... B22C 9/10; B22C 9/00; B22C 9/24; B22C 9/04; B22C 9/108; F01D 25/12; F01D 5/186; F05D 2260/202; F05D 2230/21
USPC ..... 164/27, 28, 29–33, 369, 370; 416/96 R, 416/97 R; 249/135, 175
See application file for complete search history.

(56) References Cited

U.S. PATENT DOCUMENTS 6,164,912 A 12/2000 Tabbita et al.
6,234,755 B1 5/2001 Bunker et al.
(Continued)

FOREIGN PATENT DOCUMENTS

DE 102007038858 3/2008
EP 0924384 A2 6/1999
(Continued)

OTHER PUBLICATIONS

Extended European Search Report for Application No. EP 08 25 0816 dated Jun. 25, 2008.

*Primary Examiner* — Sarang Afzali
(74) *Attorney, Agent, or Firm* — Carlson, Gaskey & Olds, P.C.

(57) ABSTRACT

A core assembly for a turbine engine blade includes a generally radially extending trunk interconnected to multiple generally axially extending tabs. The tabs are interconnected by a generally radially extending ligament. Multiple generally axially extending protrusions are interconnected to the ligament opposite the trunk. A mold is configured to define an exterior surface of an airfoil. The core is arranged within the mold and is configured such that the tabs and the ligament break through at the exterior surface.

4 Claims, 4 Drawing Sheets

(51) Int. Cl.

| | |
|---|---|
| ***B22C 9/04*** | (2006.01) |
| ***F01D 25/12*** | (2006.01) |
| ***F01D 5/18*** | (2006.01) |

(56) References Cited

U.S. PATENT DOCUMENTS

| | | | | |
|---|---|---|---|---|
| 6,637,500 | B2 * | 10/2003 | Shah et al. | 164/369 |
| 6,955,522 | B2 | 10/2005 | Cunha et al. | |
| 7,144,220 | B2 | 12/2006 | Marcin, Jr. | |
| 7,172,012 | B1 | 2/2007 | Memmen | |
| 7,174,945 | B2 | 2/2007 | Beals et al. | |
| 7,553,534 | B2 | 6/2009 | Bunker | |
| 2005/0087319 | A1 | 4/2005 | Beals et al. | |
| 2008/0057271 | A1 | 3/2008 | Bunker | |
| 2008/0107541 | A1 | 5/2008 | Cunha | |

FOREIGN PATENT DOCUMENTS

| | | | |
|---|---|---|---|
| EP | 0971095 | A2 | 1/2000 |
| EP | 1013877 | A2 | 6/2000 |
| EP | 1059419 | A1 | 12/2000 |
| EP | 1091090 | A2 | 4/2001 |
| EP | 1467064 | A2 | 10/2004 |

* cited by examiner

CAST FEATURES FOR A TURBINE ENGINE AIRFOIL

CROSS-REFERENCE TO RELATED APPLICATION

This application is a continuation application of U.S. patent application Ser. No. 13/159,469, now U.S. Pat. No. 8,695,683, which was filed Jun. 14, 2011, which is a divisional application of U.S. patent application Ser. No. 11/685,840, now U.S. Pat. No. 7,980,819, which was filed Mar. 14, 2007.

BACKGROUND

This application relates to an airfoil for a turbine engine, such as a turbine blade. More particularly, the application relates to cooling features provided on the airfoil.

Typically, cooling fluid is provided to a turbine blade from compressor bleed air. The turbine blade provides an airfoil having an exterior surface subject to high temperatures. Passageways interconnect the cooling passages to cooling features at the exterior surface. Such cooling features include machined or cast holes that communicate with the passageways to create a cooling film over the exterior surface.

In one example manufacturing process, a combination of ceramic and refractory metal cores is used to create the cooling passages and passageways. The refractory metal cores are used to create relatively small cooling passages, typically referred to as microcircuits. The microcircuits are typically too thin to accommodate machined cooling holes. The simple film cooling slots that are cast by the refractory metal cores can be improved to enhance film effectiveness. There is a need for improved film cooling slots formed during the casting process by the refractory metal cores to enhance film cooling effectiveness while using a minimal amount of cooling flow.

One prior art airfoil has employed a radial trench on its exterior surface to distribute cooling flow in a radial direction. However, the radial trench is formed subsequent to the casting process by applying a bonding layer and a thermal barrier coating to the exterior surface. This increases the cost and complexity of forming this cooling feature.

SUMMARY

In one exemplary embodiment, a core assembly for a turbine engine blade includes a generally radially extending trunk interconnected to multiple generally axially extending tabs. The tabs are interconnected by a generally radially extending ligament. Multiple generally axially extending protrusions are interconnected to the ligament opposite the trunk. A mold is configured to define an exterior surface of an airfoil. The core is arranged within the mold and is configured such that the tabs and the ligament break through at the exterior surface.

In a further embodiment of the above, the tabs extend in an axial direction. The trunk extends in a radial direction. The axial direction is at a non-perpendicular angle relative to the radial direction.

In a further embodiment of any of the above, the angle is approximately between 10-45 degrees.

In a further embodiment of any of the above, a refractory metal material provides the trunk, tabs and ligament.

These and other features of the application can be best understood from the following specification and drawings, the following of which is a brief description.

DETAILED DESCRIPTION OF THE PREFERRED EMBODIMENT

Figure 1:
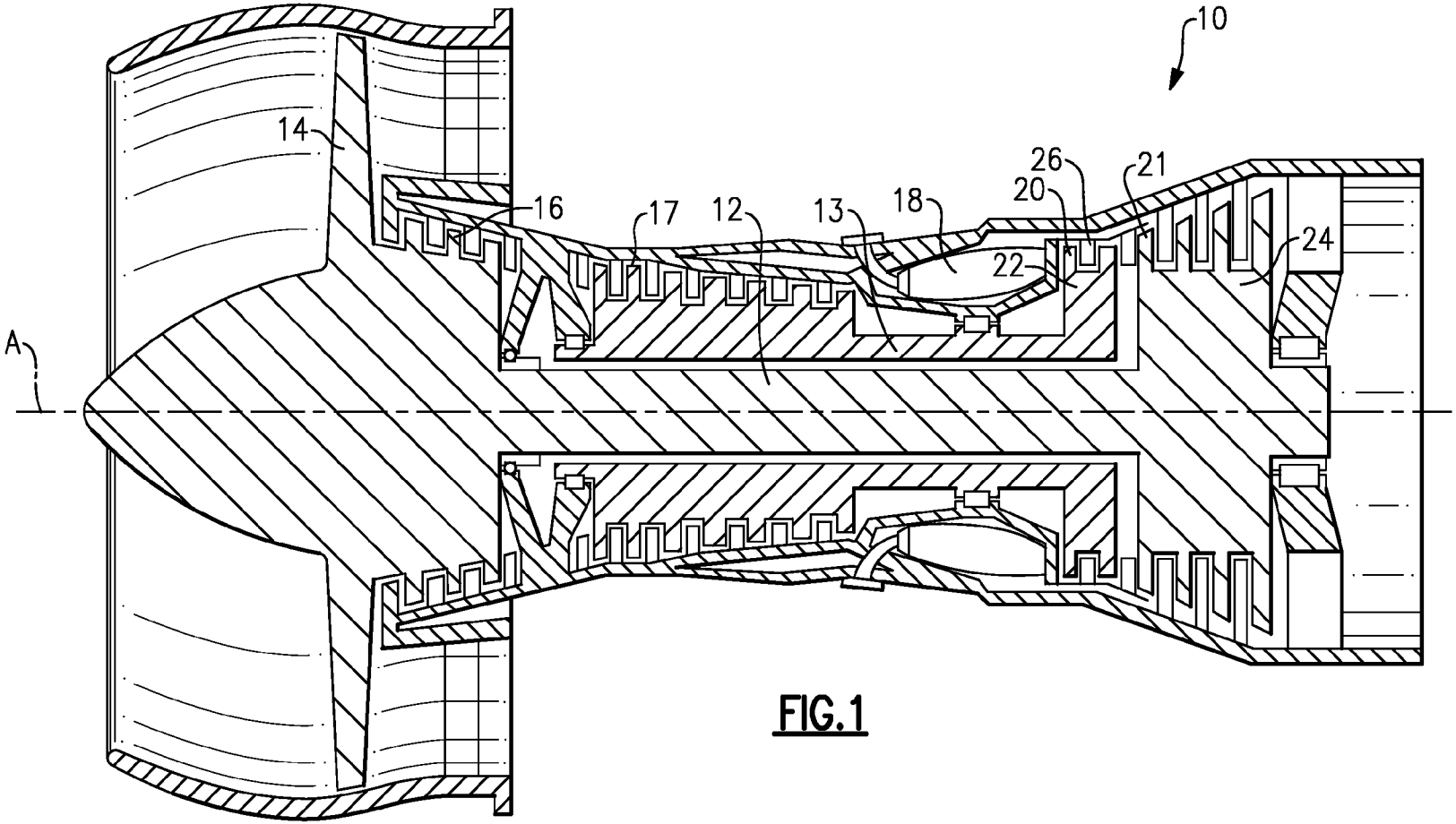
FIG. 1 is cross-sectional schematic view of one type of turbine engine.

One example turbine engine 10 is shown schematically in FIG. 1. As known, a fan section moves air and rotates about an axis A. A compressor section, a combustion section, and a turbine section are also centered on the axis A. FIG. 1 is a highly schematic view, however, it does show the main components of the gas turbine engine. Further, while a particular type of gas turbine engine is illustrated in this figure, it should be understood that the claim scope extends to other types of gas turbine engines.

The engine 10 includes a low spool 12 rotatable about an axis A. The low spool 12 is coupled to a fan 14, a low pressure compressor 16, and a low pressure turbine 24. A high spool 13 is arranged concentrically about the low spool 12. The high spool 13 is coupled to a high pressure compressor 17 and a high pressure turbine 22. A combustor 18 is arranged between the high pressure compressor 17 and the high pressure turbine 22.

The high pressure turbine 22 and low pressure turbine 24 typically each include multiple turbine stages. A hub supports each stage on its respective spool. Multiple turbine blades are supported circumferentially on the hub. High pressure and low pressure turbine blades 20, 21 are shown schematically at the high pressure and low pressure turbine 22, 24. Stator blades 26 are arranged between the different stages.

Figure 2A:
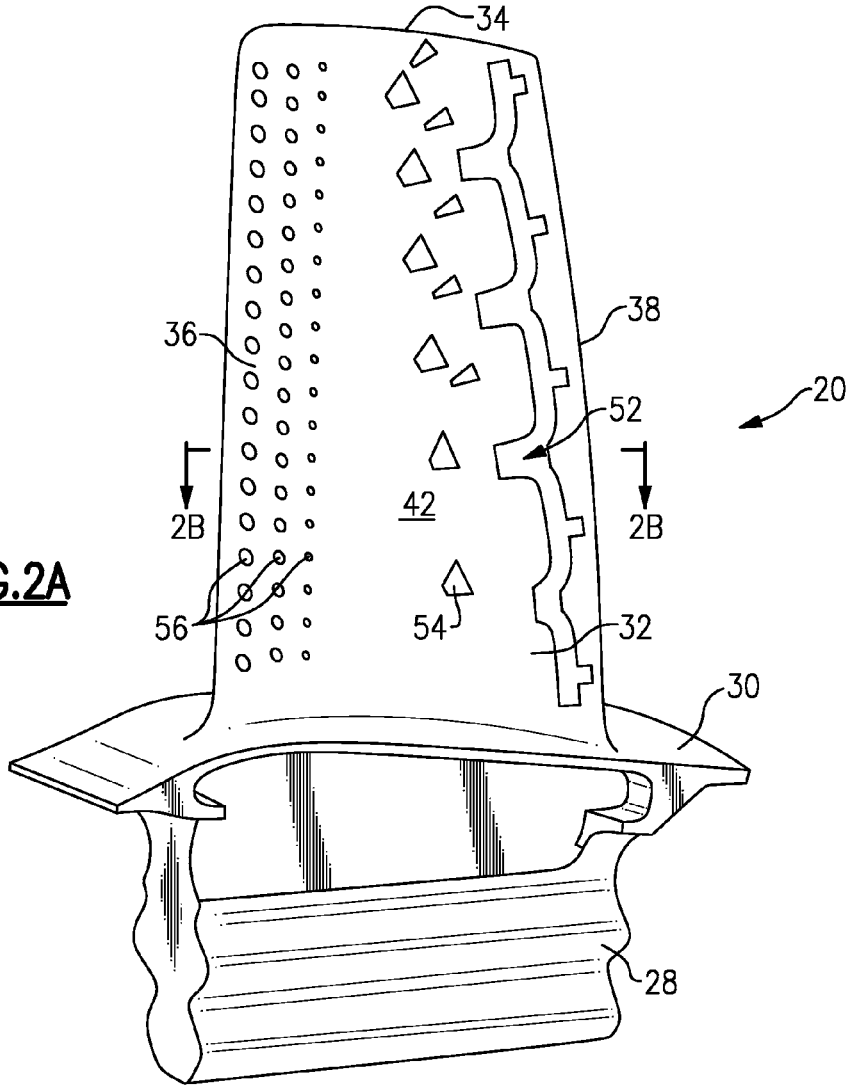
FIG. 2*a* is a perspective view of a turbine engine blade.
Figure 2B:
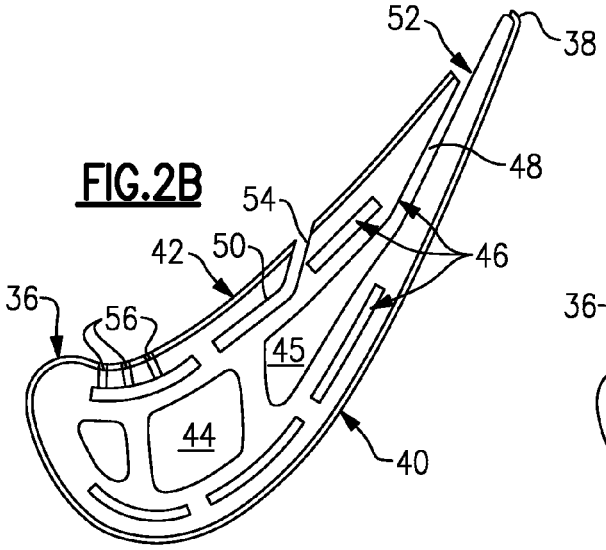
FIG. 2*b* is a cross-section of the turbine engine blade shown in FIG. 2*a* taken along line 2*b*-2*b*.

An example high pressure turbine blade 20 is shown in more detail in FIG. 2*a*. It should be understood, however, that the example cooling features can be applied to other blades, such as compressor blades, stator blades, low pressure turbine blades or even intermediate pressure turbine blades in a three spool architecture. The example blade 20 includes a root 28 that is secured to the turbine hub. Typically, a cooling flow, for example from a compressor stage, is supplied at the root 28 to cooling passages within the blade 20 to cool the airfoil. The blade 20 includes a platform 30 supported by the root 28 with a blade portion 32, which provides the airfoil, extending from the platform 30 to a tip 34. The blade 20 includes a leading edge 36 at the inlet side of the blade 20 and a trailing edge 38 at its opposite end. Referring to FIGS. 2*a* and 2*b*, the blade 20 includes a suction side 40 provided by a convex surface and a pressure side 42 provided by a concave surface opposite of the suction side 40.

A variety of cooling features are shown schematically in FIGS. 2*a* and 2*b*. Cooling passages 44, 45 carry cooling flow to passageways connected to cooling apertures in an exterior surface 47 of the structure 43 that provides the airfoil. In one example, the cooling passages 44, 45 are provided by a ceramic core. Various passageways 46, which are generally thinner and more intricate than the cooling passages 44, 45, are provided by a refractory metal core.

A first passageway 48 fluidly connects the cooling passage 45 to a first cooling aperture 52. A second passageway 50 provides cooling fluid to a second cooling aperture 54. Cooling holes 56 provide cooling flow to the leading edge 36 of the blade 20.

Figure 2C:
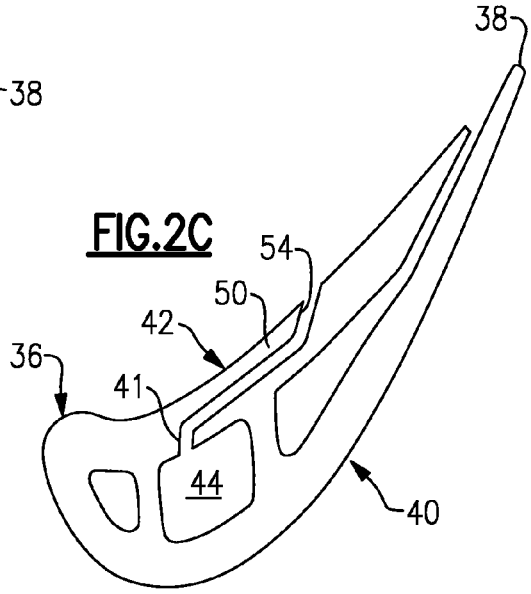
FIG. 2*c* is similar to FIG. 2*b* except it illustrates an axially flowing microcircuit as opposed to the radially flowing microcircuit shown in FIG. 2*b*.

FIG. 2*b* illustrates a radially flowing microcircuit and FIG. 2*c* illustrates an axially flowing microcircuit. In FIG. 2*c*, the second passageway 50 is fluidly connected to the cooling passage 44 by passage 41. Either or both of the axially and radially flowing microcircuits can be used for a blade 20. The cooling flow through the passages shown in FIG. 2*c* is shown in FIG. 3*d*.

Figure 3A:
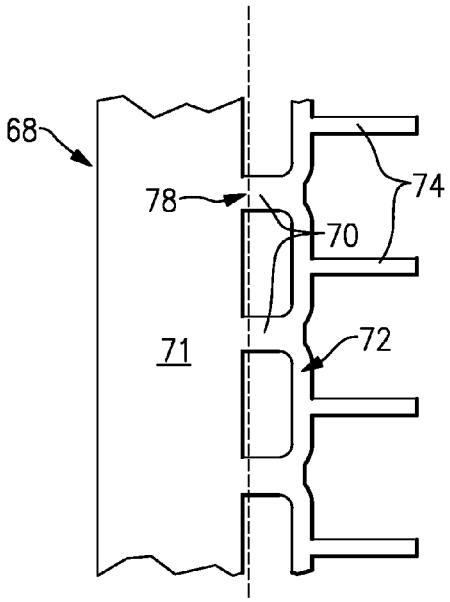
FIG. 3*a* is a plan view of an example refractory metal core for producing a radially flowing microcircuit.

Referring to FIG. 3*a*, an example refractory metal core 68 is shown. The core 68 includes a trunk 71 that extends in a generally radial direction relative to the blade. Generally, axially extending tabs 70 interconnect the trunk 71 with a radial extending ligament 72 that interconnects the tabs 70. Multiple generally axially extending protrusions 74 extend from the ligament 72. In one example, the protrusions 74 are radially offset from the tabs 70. In one example, the core 68 is bent along a plane 78 so that at least a portion of the tabs 70 extend at an angle relative to the trunk 71, for example, approximately between 10-45 degrees.

Figure 3B:
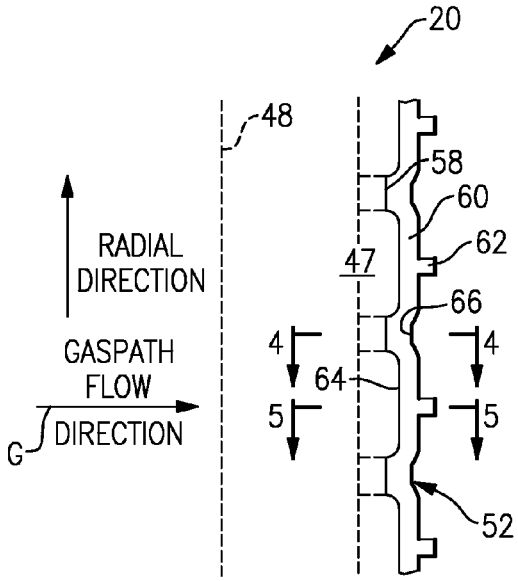
FIG. 3*b* is a plan view of the cooling feature provided on an exterior surface of an airfoil with the core shown in FIG. 3*a*.

An example blade 20 is shown in FIG. 3*b* manufactured using the core 68 shown in FIG. 3*a*. The blade 20 is illustrated with the core 68 already removed using known chemical and/or mechanical core removal processes. The trunk 71 provides the first passageway 48, which feeds cooling flow to the exterior surface 47. The tabs 70 form cooling slots 58 that provide cooling flow to a radially extending trench 60, which is formed by the ligament 72. Runouts 62 are formed by the protrusions 74.

Figure 4:
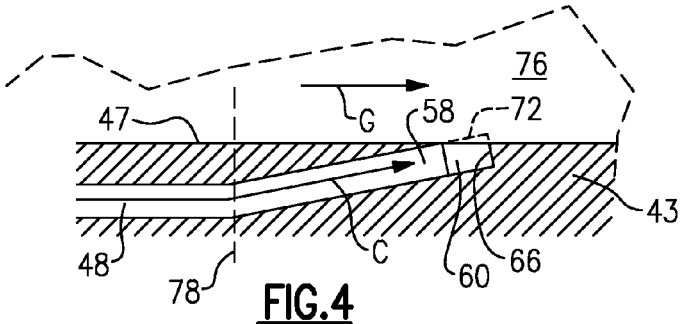
FIG. 4 is a cross-sectional view taken along line 4-4 in FIG. 3*b*.
Figure 5:
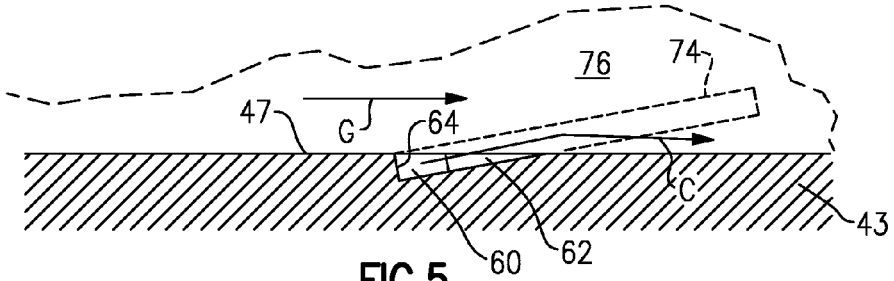
FIG. 5 is a cross-sectional view of the airfoil shown in FIG. 3*b* taken along line 5-5.

Referring to FIGS. 4 and 5, the radial trench 60 is formed during the casting process and is defined by the structure 43. As shown in FIGS. 4 and 5, a mold 76 is provided around the core 68 to provide the structures 43 during the casting process. The ligament 72 is configured within the mold 76 such that it breaks the exterior surface 47 during the casting process. Said another way, the ligament 72 extends above the exterior surface such that when the core 68 is removed the trench is provided in the structure 43 without further machining or modifications to the exterior surface 47. Similarly, the protrusions 74 extend through and break the surface 47 during the casting process. The protrusions 74 can be received by the mold 76 to locate the core 68 in a desired manner relative to the mold 76 during casting. However, it should be understood that the protrusions 74 and runouts 62, if desired, can be omitted.

Figure 3C:
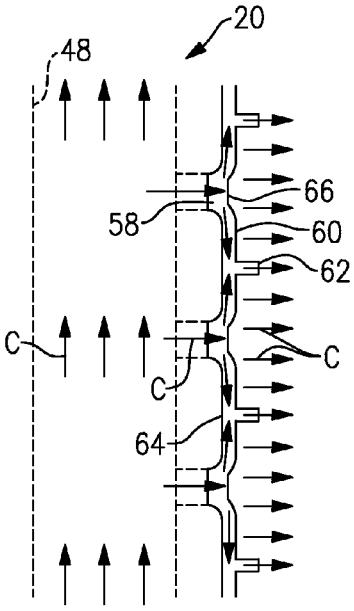
FIG. 3*c* is a schematic illustration of the cooling flow through the cooling features shown in FIG. 3*b*.
Figure 3D:
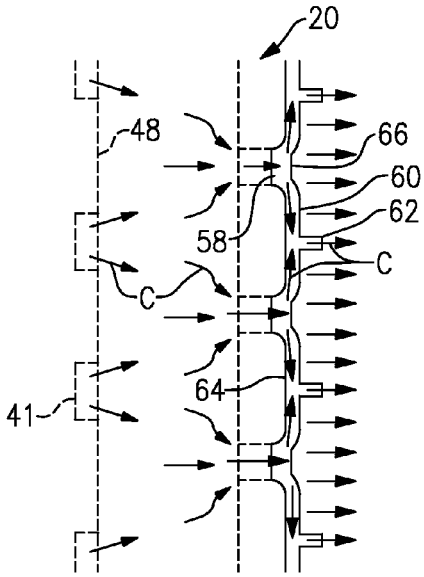
FIG. 3*d* is a plan view similar to FIG. 3*c* except it is for an axially flowing microcircuit.

As shown in FIG. 5, during operation within the engine 10, the gas flow direction G flows in the same direction as the runouts 62. The cooling flow C lays flat against the exterior surface 47 in response to the flow from gas flow direction G. The cooling flow C within the cooling features is shown schematically in FIG. 3*c*. Cooling flow C in the first passageway 48 feeds cooling fluid through the cooling slots 58 to the trench 60. The cooling flow C from the cooling slot 58 impinges upon one of opposing walls 64, 66 where it is directed along the trench 60 to provide cooling fluid C to the runouts 62. The shape of the trench 60 and cooling slots 58 can be selected to achieve a desired cooling flow distribution.

Figure 6A:
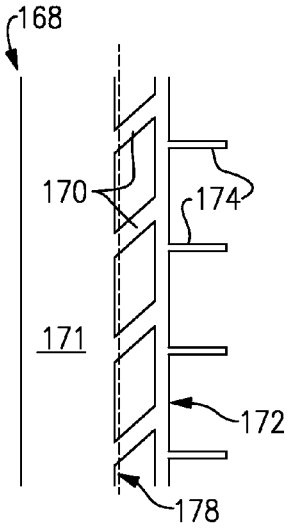
FIG. 6*a* is a plan view of another example refractory metal core.
Figure 6B:
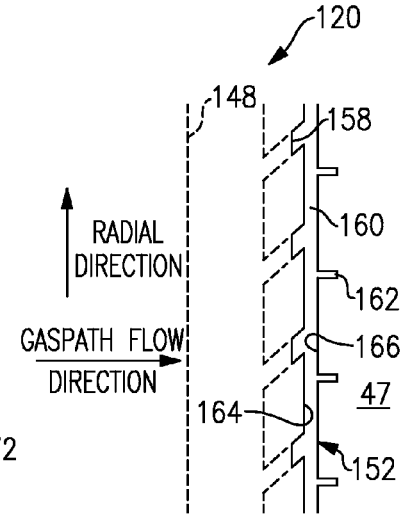
FIG. 6*b* is a plan view of another example exterior surface of an airfoil.
Figure 6C:
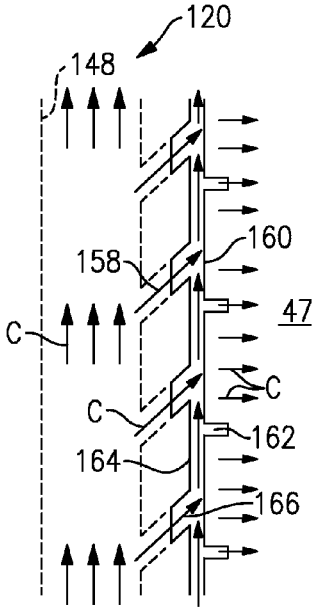
FIG. 6*c* is a schematic view of the cooling flow through the cooling features shown in 6*b*.

Another example core 168 is shown in FIG. 6*a*. Like numerals are used to designate elements in FIGS. 6*a*-6*c* as were used in FIGS. 3*a*-3*c*. The core 168 includes a trunk 171 that extends in a generally radial direction relative to the 120 blade. The trunk 171 provides the first passageway 148 that fluidly connects to a first cooling aperture 152. Generally, axially extending tabs 170 interconnect the trunk 171 with a radial extending ligament 172 that interconnects the tabs 170. Multiple generally axially extending protrusions 174 extend from the ligament 172. Runouts 162 are formed by the protrusions 174. In one example, the protrusions 174 are radially offset from the tabs 170. In one example, the core 168 is bent along a plane 178 so that at least a portion of the tabs 170 extend at an angle relative to the trunk 171. The tabs 170 are arranged relative to the trunk 171 and ligament 172 at an angle other than perpendicular. The tabs 170, ligament 172 and protrusions 174 break the exterior surface 47 during the casting process, as shown in FIG. 6*b*. Said another way, the tabs 170, ligament 172 and protrusions extends above the exterior surface such that when the core 68 is removed corresponding passages are provided in the structure without further machining or modifications to the exterior surface 47. As a result, the cooling flow C exiting the cooling slots 158 flows in a radial direction through the trench 160 toward the tip 34 when it impinges upon the wall 166.

Although a preferred embodiment has been disclosed, a worker of ordinary skill in this art would recognize that certain modifications would come within the scope of the claims. For that reason, the following claims should be studied to determine their true scope and content.

What is claimed is:

1. A core assembly for a turbine engine blade comprising:

a generally radially extending trunk interconnected to multiple generally axially extending tabs, the tabs interconnected by a generally radially extending ligament, and multiple generally axially extending protrusions interconnected to the ligament opposite the tabs; and a mold configured to define an exterior surface of an airfoil, the core arranged within the mold and configured such that the tabs and the ligament break through at and extend above the exterior surface.

2. The core assembly according to claim 1, wherein the tabs extend in an axial direction, and the trunk extends in a radial direction, the axial direction is at a non-perpendicular angle relative to the radial direction.

3. The core assembly according to claim 2, wherein the angle is approximately between 10-45 degrees.

4. The core assembly according to claim 1, comprising a refractory metal material providing the trunk, tabs, ligament and protrusions.

* * * * *